United States Patent [19]

Butcher

[11] Patent Number: 4,979,741

[45] Date of Patent: Dec. 25, 1990

[54] BATTING TRAINING APPARATUS

[76] Inventor: Gary J. Butcher, 4 Shady Vista Rd., Palos Verdes, Calif. 90274

[21] Appl. No.: 413,640

[22] Filed: Sep. 29, 1989

[51] Int. Cl.[5] ..... A63B 69/40

[52] U.S. Cl. ..... 273/26 R

[58] Field of Search ..... 273/26 R, 29 A, 33, 273/201–212

[56] References Cited

U.S. PATENT DOCUMENTS

| | | | |
|---|---|---|---|
| 3,414,268 | 12/1968 | Chase | 273/211 |
| 3,883,138 | 5/1975 | Chorey | 273/211 |
| 3,947,027 | 5/1976 | Brown | 273/33 |

FOREIGN PATENT DOCUMENTS

| | | | |
|---|---|---|---|
| 47811 | 11/1978 | United Kingdom | 273/211 |

*Primary Examiner*—Theatrice Brown

*Attorney, Agent, or Firm*—Edward E. Roberts

[57] ABSTRACT

Batting training apparatus which includes a base member, a support attached to the base in a generally vertical orientation, with a ball support cupped tee formed at the top thereof. The support is preferably formed of two or more portions, at least the upper ball support portion of which flexes upon impact of a bat with the ball supported thereon. Mounted on the support in proximity to the ball support end is a generally planar member, preferably in the form of a disc, which is adjustable relative to the ball and lies in a plane generally perpendicular to the longitudinal axis of the support, that is, horizontal to the ground. In use, with a ball mounted on the support, and with the planar member properly adjusted relative to the ball, the operator, on swinging at the ball, will be able to see and feel if the swing impacts with the planar member or not, and be able to determine whether, upon impact with the planar member, if the impact was occasioned by an up swing or a down swing.

14 Claims, 1 Drawing Sheet

BATTING TRAINING APPARATUS

BACKGROUND OF THE INVENTION

The background of the invention will be discussed in two parts.

Field of the Invention

This invention relates to batting training apparatus, and more particularly to such baseball or softball batting training apparatus including provision for enabling the user to determine an improper swing.

Description of the Prior Art

In baseball, when batting, it is desirable for the batter to maintain a proper swing in order to achieve a measure of consistency. The proper swing is ordinarily a level swing through the strike zone as the ball reaches the strike zone. In practice, without expensive video recording equipment, it is difficult for the batter to make a self-assessment that a swing is or is not level. Even with an observer, it is often difficult to determine if a swing is other than a truly level swing.

Training aids for batting practice have been devised to assist would be batters to enhance their batting skill. One such device is shown and described in U.S. Pat. No. 2,527,906, entitled "Baseball Practice Apparatus", which issued on Oct. 31, 1950 to Bennett et al, the apparatus therein including a base member incorporating means for storage of the tee device.

Another such apparatus is shown and described in U.S. Pat. No. 2,284,250, entitled "Practice Tee", which issued to Patterson on Apr. 28, 1959, such patent showing a baseball batting practice tee having a flexible upper ball holding portion and a tethered ball.

Yet another such related device is shown in U.S. Pat. No. 2,616,692, entitled "Adjustable Batting Tee", which patent issued Nov. 4, 1952, to Bird, and shows an articulated tee mounting arrangement.

Another such batting practice apparatus is shown in U.S. Pat. No. 2,976,041, entitled "Baseball Practice Standard", which patent issued to White on Mar. 21, 1961.

Other prior art devices intended for batting practice, which includes a ball supporting tee or cup, a base, and a movable arm or stand between the two are shown and described in U.S. Pat. No. 3,039,770, entitled "Adjustable Pitching Tee", which issued to Ferretti on June 19, 1962; U.S. Pat. No. 3,489,411, entitled "Coaches Batting Aid", which issued to Morelli et al on Jan. 13 1970; U.S. Pat. No. 4,176,838, entitled "Batting Baseball Tee", which issued to Griffin on Dec. 4, 1979; U.S. Pat. No. 4,383,686, entitled "Batting Tee", which issued to Cardieri on May 17, 1983; and U.S. Pat. No. 4,445,685, entitled "Batting Tee", which issued to Cardieri on May 1, 1984.

U.S. Pat. No. 4,456,250, entitled "Baseball Teaching Device", issued to Perrone, Jr. on Jan. 26, 1984, and shows and describes an apparatus that includes three generally identical height adjustable ball support pole members mounted on a common base, the three ball support pole members being arranged on the base and relative to the batter as a forward pole and two rear poles. Each rear pole is adapted to support a lightweight ball and the forward pole is adapted to support a softball or baseball. The poles are positioned at substantially the same vertical height to define a plane in which a bat swung by a player must travel to contact all three balls placed in the poles.

A more complicated training device is shown and described in U.S. Pat. No. 4,679,790, entitled "Baseball Exercising Device", which issued to Ham on July 14, 1987.

With such prior art devices, the object of the practice is simply to swing at a ball suspended by a support, pole or arm, having a flexible portion in proximity to the ball support end, or having a weighted rocking support structure. In actual batting, however, simple impact with the ball is not sufficient to produce a hit ball with a high probability of repeatability. A repeatable swing is desired, preferably in a generally level plane, that is generally horizontal to the ground. This aspect is discussed in the Perrone patent; however, the apparatus is unduly complicated and unduly expensive to fabricate.

Accordingly, in accordance with an aspect of the invention, an uncomplicated, relatively inexpensive new and improved batting training apparatus is provided.

SUMMARY OF THE INVENTION

The foregoing and other objects of the invention are accomplished by providing baseball or softball batting training apparatus which includes a base member, a suPPort attached to the base in a generally vertical orientation, with a hall support cup or tee formed at the top thereof. The support is preferably formed of two or more portions, at least the upper ball support portion of which flexes upon impact of a bat with the ball supported thereon. Mounted on the support in proximity to the ball support end is a generally planar member, preferably in the form of a disc, which is adjustable relative to the ball and lies in a plane generally perpendicular to the longitudinal axis of the support, that is, horizontal to the ground. In use, with a ball mounted on the support, and with the planar member properly adjusted relative to the ball, the operator, on swinging at the ball, will be able to see and feel if the swing impacts with the planar member or not, and be able to determine whether, upon impact with the planar member, if the impact was occasioned by an up swing or a down swing.

Other objects, features and advantages will become apparent from a reading of the following specification, when taken in conjunction with the drawings, wherein like reference numerals refer to like elements in the several views.

DETAILED DESCRIPTION OF THE PREFERRED EMBODIMENT

Figure 1:
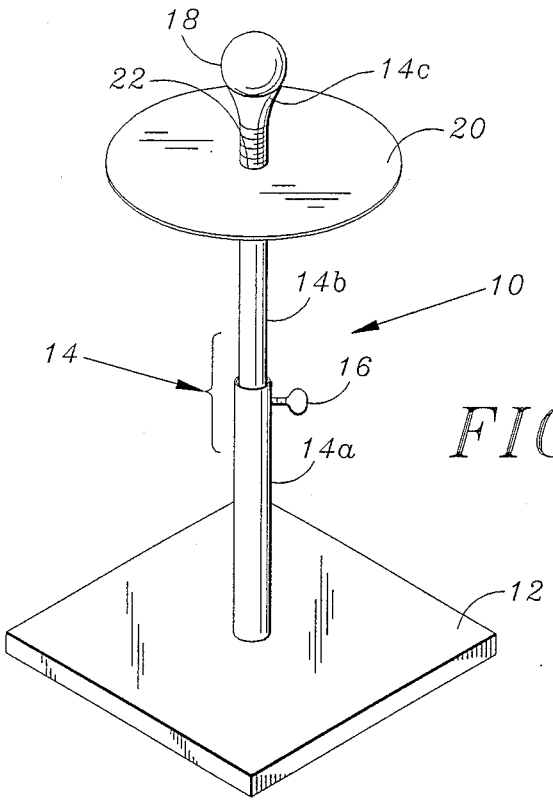
FIG. 1 is a perspective view of a batting training apparatus in accordance with the invention.

Referring now to the drawings, and particularly to FIG. 1 there is shown a baseball or softball batting training apparatus, generally designated 10, having a support means including a base plate 12 of generally square or rectangular form with a generally centrally positioned upwardly extending tubular support post, generally designated 14. The support post 14 may be formed of one or two parts, but in the preferred embodiment is formed of two parts 14a and 14b, telescopically engaging one another. The lower support post member 14a is affixed to the base 12 substantially at the geometrical center thereof in perpendicular relation thereto. The support post member 14a is generally tubular in form with an inner diameter generally corresponding to the outer diameter of the upper support post member 14b, which is slidably received therein. The height or position of post member 14b can be adjusted relative to the base 12 by any appropriate means. As shown, one means is whereby a threaded aperture is located adjacent the upper end of the lower post member 14a for receiving a thumbscrew member 16, which can be tightened to secure the position of the upper post member 14b relative to the lower post member 14a. The support post 14 is configured for flexing during use and, in the preferred embodiment, at least the upper support post member 14b is formed of a flexible durable resilient material.

The upper extremity of upper post member 14b is configured in the shape of a tee 14c, that is, of an inverted conical shape, with a depression for receiving and retaining therein, under the force of gravity, a ball 18. The tee, or ball support, 14c can be attached to post member 14b as an extention. thereof, or it can be a separate part configured for telescopically engagement with member 14b. To enable the user to determine a proper swing plane, a disc-shaped batting swing plane member 20 is provided., the member 20 having an aperture 22 at the center thereof, the aperture 22 being of a diameter sufficient for slidably positioning the batting swing plane member 20 on the upper support post member 14b.

Figure 2:
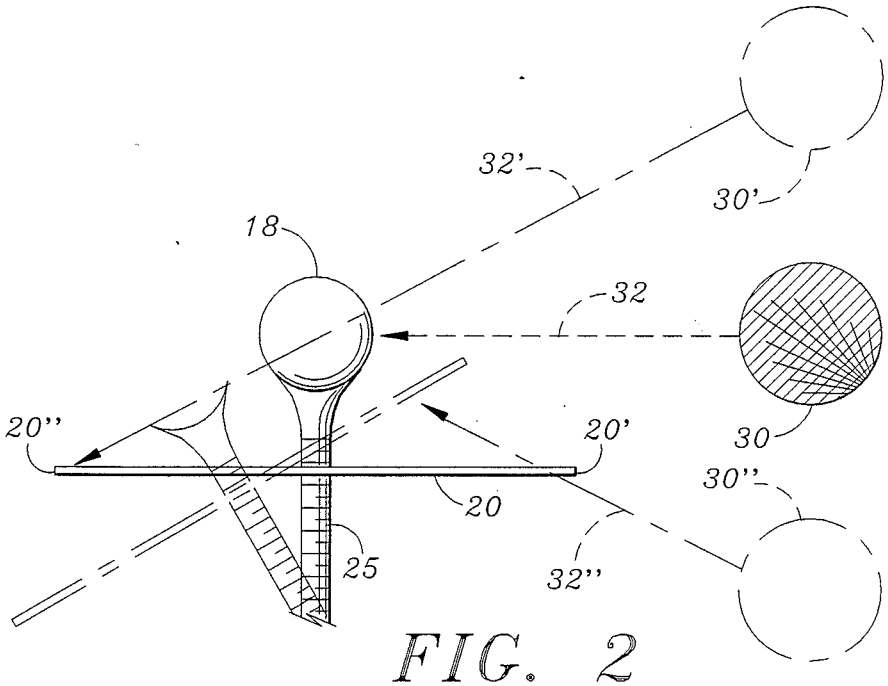
FIG. 2 is a side diagrammatic view of the upper ball retaining portion of the apparatus of FIG. 1, with a solid line depiction of a cross-section of a bat relative to the ball for swinging in a horizontal plane, and dotted line depictions of the bat in position for impact with the planar member on a up swing or down swing.

The configuration of the swing plane member 20 is of a diameter large enough to provide a clearly defined swing plane while small enough so as not to unduly protrude into the batter's area during the swing. The swing plane member 20 is shown as being disc-shaped, that is, circular in plan view. This configuration has been selected as the most convenient configuration, although any other shape may be used. The swing plane member 20 and the upper support post member 14b may be formed of any suitable material, such as flexible, durable rubber or plastic composition material. The matching of the diameter of the opening or aperture 22 of the swing plane member 20 to the outer diameter of the upper support post member 14b is such to provide a certain amount of frictional resistance, while permitting slidable movement of the swing plane member relative to the post member 14b to set the swing plane member 20 to the desired position relative to the tee 14c, and, hence, the ball 18. As shown in FIG. 2, the support post member 14b may be provided with indicia 25, such as scribe marks or imprinted markings in order to enable the user to consistently set the swing plane member at the desired position relative to the tee 14c.

By reference to FIG. 2, the use of the apparatus 10 will now be described. There is shown, in cross-section, a bat 30, in both solid lines with reference numeral 30, and two positions shown in broken lines, designated 30' and 30''. Directed from the bat 30 in the three depictions are three broken lines 32, 32' and 32'', each corresponding to a direction of travel of the bat 30, 30' and 30'', respectively, each having an arrow at the end thereof at the point of impact with the ball 18. The swing plane member 20 includes a designation 20' at the near end relative to the bat 30 and 20'' at the far end relative to the bat 30. The swing plane member 20 and the upper end of post member 14b are shown in a second deflected position in broken lines.

In use, the batter pre-positions the location of the tee 14c relative to a desired swing position according to the height and swing style of the particular batter. This is accomplished by telescopically adjusting the upper post member 14b relative to the lower post member 14a and tightening the thumbscrew 16. The batter then adjusts the swing plane member 20 by sliding it along the shaft of the upper support post member 14b to the desired position relative to the tee 14c, and ball 18 thereon. The swing plane member, upon setting by appropriate means, defines a plane which is generally perpendicular to the axial centerline of the upper post member 14b, and lies in a plane generally parallel to the ground on which the base 12 rests.

The batter then swings the bat 30 through and at the ball 18 while attempting to maintain a swing in a given plane or with slight angular tilt. During this practice, the bat 30 shown in solid lines follows the path 32 directly through the ball 18 without contact with the swing plane member 20. The upper end of the apparatus 10 will deflect to the broken line position upon impact but, the absence of contact between the bat 30 and swing plane member 20 will be noticeable to the batter.

On the other hand, if the swing of the bat 30 is other than parallel to the ground, such as when the bat 30' follows a downwardly directed path 32', the far end 20'' of the swing plane member 20 will be contacted subsequent to contact with the ball 18. Although these two contacts will be spaced apart a very small measure of time, this contact will be sensed by the batter both physically, by feeling the second later impact with the swing plane member 20, and visually by gyrations of the swing plane member 20 relative to the support post member 14b.

Similarly, if the swing of the bat 30 is other than parallel to the ground, such as when the bat 30'' follows an upwardly directed path 32'', the near end 20' of the swing plane member 20 will be contacted prior to contact with the ball 18. This contact will be sensed by the batter both physically, by feeling the swing plane member 20 impact prior to ball 18 impact, and visually by gyrations of the swing plane member 20 relative to the support post member 14b.

In use, the batter will experiment with the position of the swing plane member 20 relative to the tee 14c, and the height of the upper post member 14b relative to the base plate 12 until the optimum settings are obtained during practice. Initially, for an inexperienced batter, the spacing between the tee 14c and swing plane member 20 may be greater, until after improvement with practice, the spacing can be reduced to provide a precisely level swing plane for the batter in training.

It is to be understood that the swing plane member 20 may also be square, rectangular, or some other desired configuration. Additionally, members 12, 14a, 14b, 14c, and 20 may be separate pieces configured for attachment telescopically, or other appropriate means, for easy assembly/disassembly for storage and/or portability, or various ones of these members may be molded as a single unit. For instance, base plate member 20 may be separate from or molded to post member 14b.

While there has been shown and described a preferred embodiment, it is to be understood that various other adaptations and modifications may be made within the spirit and scope of the invention.

What is claimed is:

1. A batting training apparatus comprising:

a base means configured and adapted for resting on a support surface; a hollow vertically extending first post section having one of its ends attached to said base, a second support post section having one of its ends telescopically received in said first post section, said second post section having means at its other end configured for supporting a ball at a predetermined elevation relative to said base means, means adjustably affixed to said second post section and said base adjacent said other end to define a swing plane whereby a user can swing a bat at a ball resting on said support means and sense contact with said swing plane defining means and will know that the swing of the bat is not in a horizontal plane.

2. The apparatus according to claim 1 wherein said support means is at least partially flexible to flex upon impact of a bat with a ball resting on said other end.

3. The apparatus according to claim 1 wherein said support means includes engaging support post members, and at first and second telescopically at least one of said support sections is flexible to flex impact of a bat with a ball resting on said other end 4. The apparatus according to claim 1 wherein said swing plane means is a planar member slidably attached to said second post sections.

5. The apparatus according to claim 4 wherein at least one of said post sections is at least partially flexible to flex upon impact of a bat with a ball resting on said other end.

6. The apparatus according to claim 1 wherein said first support post section is generally rigid and said second support post section is formed of a flexible material.

7. Batting training apparatus comprising:

a base member configured and adapted for resting on a surface; vertically extending support means on said base member for supporting a ball at a predetermined elevation relative to said base member, said support including first and second interconnected support post members, said first post member being connected to said base member and said second post member being adjustable relative to said first post member so that one of its ends is at a desired distance from said base member;

ball retaining means affixed at said one end; means defining a swing plane adjustably affixed to said second support means and positionable relative to said ball retaining means, in use, said swing plane means being positioned adjacent said ball retaining means in a generally horizontal plane so that with a ball resting thereon, a user can swing a bat at said ball and sense contact with said swing plane means when the swing of the bat is not in a generally horizontal plane.

8. The apparatus according to claim 7 wherein said first and second support post members are telescopically engaged and at least one of said first and second support post members and said ball retaining means is at least partially flexible to flex upon impact of a bat with a ball resting on said other end.

9. The apparatus according to claim 8 wherein said first support post member is attached to said base means and said second support post member is telescopically attached to said first support post member and said ball retaining means are integrally formed in the free end of said second support post member.

10. The apparatus according to claim 9 wherein said ball retaining means includes an integrally formed inverted generally conically shaped portion with a depression in the upper surface thereof configured for receiving a ball resting thereon.

11. The apparatus according to claim 7 wherein said swing plane means is a planar member slidably attached to said second support post member.

12. The apparatus according to claim 11 wherein said second support post member includes indicia to enable the user to consistently set said swing plane means at a desired position relative to said ball retaining means.

13. The apparatus according to claim 8 wherein said first support post member is attached to said base means and said second support post member is telescopic relative thereto, and said ball retaining means is telescopic relative to said second support post member.

14. The apparatus according to claim 13 wherein said ball retaining means are integrally formed with said swing plane means and is telescopic relative to said second support post member.

* * * * *